United States Patent [19]

Kostylev et al.

[11] Patent Number: 4,570,723

[45] Date of Patent: Feb. 18, 1986

[54] MACHINE FOR DRIVING HOLES IN THE GROUND

[75] Inventors: Alexandr D. Kostylev; Andron T. Karavaev; Vladimir D. Plavskikh; Alexei D. Terskov; Nikolai P. Chepurnoi, all of Novosibirsk; Igor I. Reznikov; Vladimir I. Tarasenko, both of Odessa, all of U.S.S.R.

[73] Assignee: Institut Gornogo Dela Sibirskogo Otdelenia Akademii Nauk SSSR, Novosibirsk, U.S.S.R.

[21] Appl. No.: 610,836

[22] Filed: May 16, 1984

[30] Foreign Application Priority Data

May 16, 1983 [SU] U.S.S.R. ..... 3632032

[51] Int. Cl.[4] ..... B25F 5/02

[52] U.S. Cl. ..... 173/116; 173/90; 175/19

[58] Field of Search ..... 173/116, 125, 134–138, 173/90, 127, 126, 117–119; 175/19, 61, 73, 390, 20–23, 389, 414–420, 295, 405, 407, 422

[56] References Cited

U.S. PATENT DOCUMENTS 4,132,277 1/1979 Tupitsyn et al. ..... 175/19

4,144,941 3/1979 Ritter ..... 175/19

FOREIGN PATENT DOCUMENTS 658224 5/1979 U.S.S.R. .

*Primary Examiner*—Donald R. Schran

*Assistant Examiner*—James Wolfe

*Attorney, Agent, or Firm*—Fleit, Jacobson, Cohn & Price

[57] ABSTRACT

A machine for driving holes in the ground comprises a cylindrical housing, a hammer disposed inside the housing, and an air distribution mechanism. Longitudinal recesses and projections are provided on a portion of the outer surface of the housing at its head end section. The diameter of the cylindrical part of the housing is greater than the diameter of a circle described about the bottoms of the recesses and smaller than the diameter of a circle described about the tops of the projections.

4 Claims, 3 Drawing Figures

MACHINE FOR DRIVING HOLES IN THE GROUND

FIELD OF THE INVENTION

This invention relates generally to construction machinery, and more particularly to machines for driving holes in the ground.

The machine can find application for driving holes in the ground during trenchless laying of underground communications.

BACKGROUND OF THE INVENTION

The experience of application self-propelled percussive action machines for driving holes in the ground has shown that they are very efficient and simple to operate. It has also been found that the reliable and accurate hole driving depends largely on the properties of the soil in which the hole is made. When a non-homogenious soil or a soil which has voids, rock inclusions, and construction site leftovers are encountered, the housing of such machines may be susceptible to bending to result in a curvilinear path of travel of the machines, and therefore a straight-line holes are difficult if not impossible to obtain. High bending loads exertable on the housing of the machine may cause its failure due to jamming of the hammer inside the housing.

There is known a machine for driving holes in the ground (cf., USSR Inventor's Certificate No. 658,224; published 1979) comprising a bore rod, a cylindrical calibrating portion, a tapered head end section, and a finned conical sleeve interposed between the calibrating and head end sections. The head end section is separated from the conical sleeve by a cylindrical section. The arrangement of the machine with two tapered surfaces axially spaced apart is as advantageous as one tapered section having a maximum diameter equal to the maximum diameter of the ribbed finned conical sleeve. In other words, the machine may be viewed as one having a single tapered section which, during an encounter with an obstacle of the head end section thereof will tend to deviate from the rectilinear forward path to result in a curved hole.

There is also known an apparatus for driving holes in the ground as exemplified in U.S. Pat. No. 4,144,941, published Mar. 20, 1979. This machine comprises a cylindrical housing having disposed therein a hammer capable of delivering impacts on a head end section of the housing and an air distribution mechanism. The head end section of the housing has a diameter greater than the diameter of the rest of the housing.

This machine is charaterized by a relatively small contact area between the walls of the housing and the ground, which results in reduction of the forces taking up the recoil of the housing during acceleration of the hammer to therefore slow down the rate of hole driving or even to terminate the travel of the housing, expecially in soils which are not compact or in moist soils. In addition, the thickened part of the housing acts to reduce the energy of impact per unit area of the hole being made to eventually slow down the rate of hole driving.

The thickened part of the head end section of the housing increases the overall mass thereof to result in less efficient transmission of impacts to the soil, which also leads to slowing down the rate of hole driving.

Further, the small length of the thickened part of the housing in contact with the ground fails to assure directional stability during the forward percussive travel of the machine in the ground, especially when the thickened conical portion of the housing encounter an obstacle, such as a boulder.

There is further known a machine for driving holes in the ground (cf., U.S. Pat. No. 4,132,277, published Jan. 2, 1979) comprising a cylindrical housing, a hammer disposed inside the housing for delivering impacts on a head end thereof, and an air distribution mechanism.

The above machine features a relatively thin-walled housing, which is favourable from the point of view of attaining a maximum impact power and maximizing the efficiency of transmission of impacts to the ground thanks to a relatively small mass of the housing.

The machine is also characterized by a sufficiently extensive length of the housing to result in a greater accuracy of the forward travel path of the machine.

However, the elongated housing with thin walls is susceptable to bending when travelling through non-uniform soils, as well as soils having voids and rock inclusion, which may cause the machine to deviate from the preset course.

Further, very pronounced bending of the housing cause operating failures due to jamming of the hammer.

SUMMARY OF THE INVENTION

One object of the present invention is to provide a machine for driving holes in the ground which would be more reliable in operation.

Another object is to attain a higher accuracy of hole driving.

One more object is to prevent operational failures of the machine caused by jamming of the hammer in the housing.

These and other objects of the invention are attained by that in a machine for driving holes in the ground comprising a cylindrical housing, a hammer disposed inside the housing for delivering impacts on a head end section of the housing, and an air distribution mechanism, according to the invention, longitudinal recesses and projections are arranged on the outer surface of the head end section of the housing, the diameter of the cylindrical portion of the housing being greater than the diameter of a circle described about the bottoms of the recesses and less than the diameter of a circle described about the tops of the projections.

Desirably, the cross-sectional area of the cylindrical portion of the housing is approximately equal to the cross-sectional area of the housing at a section thereof where the recesses and projections are arranged.

Preferably, the portion of the housing at the location of the recesses and projections is fashioned as a detachable headpiece.

The machine for driving holes in the ground embodying the features of the present invention is simple in construction and reliable in operation.

The arrangement of the longitudinal recesses and projections at the head end of the housing enables to increases the rigidity of the housing without increasing its mass, which is favourable for improving the accuracy of hole driving and preventing operational failures, while maintaining the energy of impacts transmittable by the housing to the ground.

The structural arrangement of the housing according to the features of the invention is also advantageous because of reduced transverse efforts exerted by the ground being penetrated on the housing thanks to that the front faces of the projections partially break the obstacles encountered during the forward percussive action of the machine and partially force these obstacles apart from the walls of the tail end of the housing, to eventually calibrate the hole forcing the soil from the recesses to the grooves made in the soil by the projections.

The housing of the machine embodying the invention is capable of maintaining the necessary force of friction between the housing and the ground, which prevents slippage of the housing in the ground when the housing is acted upon by the recoil forces arising during acceleration of the hammer to thereby keep the necessary speed of hole driving.

Thanks to the cross-sectional area of the cylindrical section of the housing being approximately equal to the cross-sectional area of the housing at the location of the recesses and projections a greater reliability of the machine is attained without reducing the rate of hole driving, because the volume of the soil being deformed and the diameter of the hole are maintained.

The provision of the replaceable headpiece on the head end of the housing makes it possible to vary the geometry of the head end of the housing, the rest of the housing being thus unchanged. Replacement of the headpiece may be required when the projections become worn out.

BRIEF DESCRIPTION OF THE DRAWINGS

The invention will now be described in greater detail with reference to various preferred embodiments thereof taken in conjunction with the accompanying drawings, in which.

DETAILED DESCRIPTION OF THE INVENTION

Figure 1:
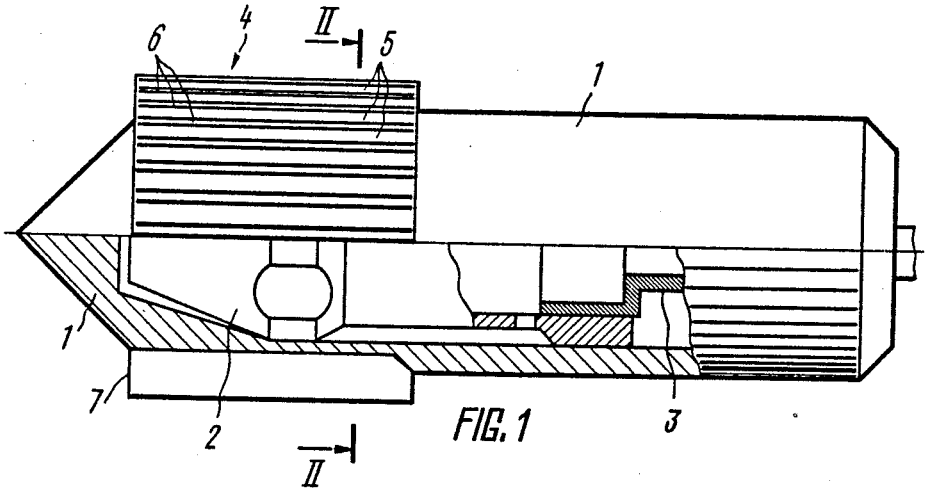
FIG. 1 is a partially longitudinal sectional view of a machine for driving holes in the ground.
Figure 2:
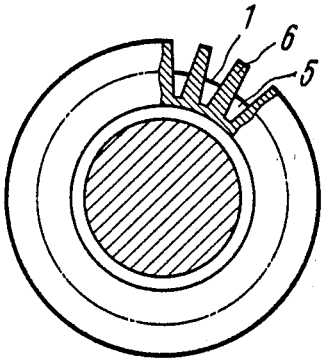
FIG. 2 is a cross-section taken along the line II—II in FIG. 1.

A machine for driving holes in the ground comprises a cylindrical housing 1 (FIGS. 1 and 2), a hammer 2 inside the housing 1, and an air distribution mechanism 3. A head end 4 of the housing 1 has longitudinal recesses 5 and projections 6 with end faces 7.

The diameter of the cylindrical part of the housing 1 is greater than the diameter of a circle described about the bottoms of the recesses 5 and smaller than the diameter of a circle described about the tops of the projections 6. The hammer 2 accommodated inside the housing 1 is capable of delivering impacts on the head end 4 of the housing 1 in response to signals developed by the air distribution mechanism 3.

Figure 3:
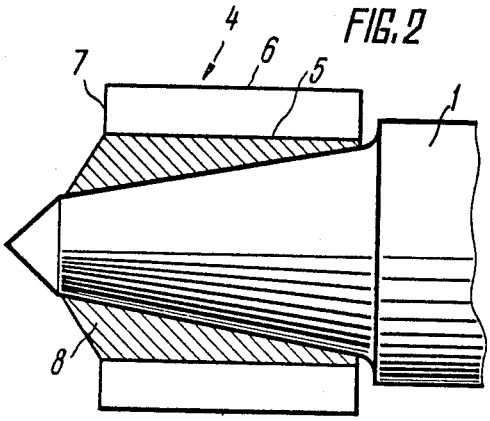
FIG. 3 illustrates a longitudinal section a head end section of the housing of the proposed machine in the form of a detachable headpiece.

With reference to FIG. 3, there is shown a modified form of the head end 4 of the housing 1 with a detachable headpiece 8 in the form of a tapered sleeve the outer surface of which is provided with the recesses 5 and projections 6.

The machine for driving holes in the ground operates in the following manner.

Under the action of compressed air fed to the air distribution mechanism 3 of the machine, the hammer 2 executes reciprocations inside the housing 1 to deliver impacts on the head end 4 or, more precisely, on an inner front end face of the housing to thereby drive it into the ground. Recoil forces arising during acceleration of the hammer 2 and acting on the housing 1 are taken up by the forces of friction developed between the outer surface of the housing 1 and the walls of the hole made in the ground.

Under the action of impacts the housing 1 and therefore the machine are moved in the ground forcing it radially apart and leaving a hole behind.

The movement of the head end 4 of the housing 1 in the ground causes the formation of depressing (grooves) produced by the projections 6 and ridges formed by the recesses 5. The cylindrical tail section of the housing 1 acts to calibrate the hole by forcing the ground from the recesses 5 of the housing 1 to grooves produced by the projections 6.

When rock inclusions are encountered, these are partially broken by the front end faces 7 of the projections 6 and partially forced radially away from the centerline of the machine, whereby the cylindrical section of the housing 1 is not subject to the action of such inclusions to result in the absence of bending loads acting on the housing 1.

If it is known in advance that the ground to be driven into is substantially uniform and has no rock inclusions, the projections 6 are preferably to be less in height, and therefore the head end 4 (FIG. 3) is detached from the rest of the housing to be replaced by a headpiece having less pronounced projections 6.

What is claimed is:

1. A device for driving holes in the ground comprising:

a cylindrical housing including a head end;

a hammer movably disposed in said housing for delivering impacts on said head end of said housing;

an air distribution means connected to said housing for controlling the movement of said hammer;

longitudinal projections having outer surfaces and longitudinal recesses having inner surfaces, said projections and recesses arranged on the outer surface of said head end of said housing with said outer and inner surfaces extending substantially parallel to the axis of said housing;

said cylindrical housing having a diameter substantially greater than the diameter of a circle described about the inner surfaces of said recesses and less than the diameter of a circle described about the outer surfaces of said projections.

2. A device as defined in claim 1 in which the cross-sectional area of said cylindrical housing absent said projections and recess is approximately equal to the cross-sectional area of said housing at the location where said recesses and projections are disposed.

3. A device as defined in claim 1, in which said head end of the housing at the location where said recesses and projections are arranged is formed as a detachable headpiece.

4. A device as claimed in claim 1 in which said projections include end faces adjacent the head end of said housing, said end faces extending transversely outwardly relative to the axis of said housing.

* * * * *